US006703088B2

(12) United States Patent
Hayashi et al.

(10) Patent No.: US 6,703,088 B2
(45) Date of Patent: Mar. 9, 2004

(54) THERMAL TRANSFER SHEET

(75) Inventors: Masafumi Hayashi, Tokyo-to (JP); Nobuho Ikeuchi, Tokyo-to (JP); Daigo Morizumi, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/966,216

(22) Filed: Sep. 28, 2001

(65) Prior Publication Data

US 2002/0061391 A1 May 23, 2002

(30) Foreign Application Priority Data

Oct. 4, 2000 (JP) ..... 2000-304445

(51) Int. Cl.[7] ..... B41M 5/40

(52) U.S. Cl. ..... 428/32.74; 428/32.77

(58) Field of Search ..... 428/195, 207, 428/209, 32.74, 32.77

*Primary Examiner*—B. Hamilton Hess
(74) *Attorney, Agent, or Firm*—Ladas & Parry

(57) ABSTRACT

The present invention provides a thermal transfer sheet, which comprises a substrate film and a metallic layer disposed on one side of the substrate film, the metallic layer being comprising leaf-shaped aluminum powder. The preferable leaf-shaped aluminum powder is obtainable via a process in which an aluminum film is formed by a vapor deposition on a peelability facilitating surface of a carrier sheet, the aluminum film is peeled off the carrier sheet and finely divided. Using the thermal transfer sheet, it is possible to produce a printed product having a high metallic luster and hiding property and excellent in qualities including design, appearance or decoration. Furthermore, it is not expensive to produce the thermal transfer sheet of the present invention.

5 Claims, 1 Drawing Sheet

THERMAL TRANSFER SHEET

BACKGROUND OF THE INVENTION

1. Field of the Invention

The present invention relates to a thermal transfer sheet adaptable to a thermal transfer printer using a heating mean such as a thermal head and a laser and, particularly, to a thermal transfer sheet capable of easily producing a printed product with metallic luster.

2. Description of the Related Art

A melting type thermal transfer system has been known, in which a thermal transfer sheet is composed of a substrate sheet and a coloring layer which is obtained by dispersing a coloring agent such as a pigment or a dye in a heat-meltable binder such as wax or a resin and supported by the substrate sheet such as a plastic film, and energy corresponding to image information is applied to the thermal transfer sheet by means of a heating device such as a thermal head, and thus the coloring agent is transferred from the thermal transfer sheet to an image-receiving sheet such as paper or a plastic sheet together with the binder.

An image printed by this melting type thermal transfer system has high density and superior sharpness and is therefore suitable for the recording of binary images such as characters and line drawings. In addition, when plural coloring layers such as yellow, magenta, cyan and black are used for printing and recorded on the image-receiving sheet in a superposed manner with the use of one or more thermal transfer sheets, a multicolor or full color image can be formed by subtractive color mixing.

There is an increasing demand for a melting type thermal transfer system applicable to production of a printed product having metallic luster or metallic brightness and thus excellent in design, appearance or decoration.

In order to meet such a demand, Japanese Patent Laid-open Publication Nos. Hei 10(1998)-16415 discloses a thermal transfer sheet having metallic luster, in which an anchor layer for vapor deposition, a metallic vapor deposition layer and an adhesive layer are composed on one side of a substrate in this order from a side near the substrate.

Japanese Patent Laid-open Publication Nos. sho 63(1988)-290789 discloses a thermo-sensitive transfer material in which an ink layer composed by dispersing a metallic powder pigment such as aluminum and bronze in a heat meltable vehicle is disposed on a support film.

However, in a case where the metallic vapor deposition layer is formed on the substrate so as to be peelable, special methods such as a gaseous phase process including vacuum deposition and sputtering are required to form the metallic vapor deposition layer. In such a method, the metallic vapor deposition layer is formed into a thin film with a thickness of about 200–600 Å on the substrate, and it poses some problems that the metallic vapor deposition layer is liable to be cracked by impact or exposing outdoors because of its poor flexibility, and that the metallic vapor deposition layer is a thin film liable to transmit the light and thus being inferior in hiding property for hiding the ground face, and further that a process cost is very expensive.

On the other hand, in a case where the ink layer dispersing the pigment of metallic powder in the heat meltable vehicle is formed on the support film, the printed product is inferior in the metallic luster and the hiding property than the above described type using the metallic vapor deposition layer and therefore unsatisfying in qualities.

SUMMARY OF THE INVENTION

Accordingly, it is an object of the present invention to provide a thermal transfer sheet having a high metallic luster and hiding property and a good reproduction of color even if a colored receiving paper is subjected to printing, and thus capable of forming a printed product excellent in qualities including design, appearance or decoration, and further capable of being manufactured at a low cost by an easy process.

To achieve the above mentioned object, the present invention provides a thermal transfer sheet which comprises a substrate film and a metallic layer disposed on one side of the substrate film, the metallic layer being comprising leaf-shaped aluminum powder.

The leaf-shaped aluminum powder to be preferably used is one obtainable via a process in which an aluminum film is formed by a vapor deposition on a peelability facilitating surface of a carrier sheet, and the aluminum film is peeled off the carrier sheet and finely divided.

It is preferable that the thermal transfer sheet of the present invention is further provided with a peelable layer which is disposed between the substrate film and the metallic layer. The peelable layer facilitates the metallic layer to peel off the substrate film at the time of thermal transfer printing.

It is preferable that the peelable layer contains a coloring agent. The peelable layer containing the coloring agent can reproduce a hue of a chromatic color having metallic luster such as golden, copper and bronze colors.

It is preferable that the thermal transfer sheet is further provided with an adhesive layer as an outermost layer which is disposed on the metallic layer, and the adhesive layer can firmly bond the metallic layer to a surface of a transfer receiving material.

The thermal transfer sheet of the present invention has a structure in which the metallic layer containing at least leaf-shaped aluminum powder is disposed on one side of the substrate film. When the thermal transfer sheet of such a structure is used to form an aluminum coating film on a printed surface, the aluminum coating film thus formed has a scaly configuration composed of aluminum fine peaces, in which many peaces of the leaf-shaped aluminum powder come to the surface of the aluminum coating film and almost closely arranged along a lateral direction with edges of the respective peaces of the leaf-shaped aluminum powder being in contact or overlapped with each other, thus producing a highly smooth coating of aluminum and obtaining a printed product which has a high hiding property and metallic luster and is excellent in qualities including design, appearance or decoration.

Furthermore, the metallic layer comprising the leaf-shaped aluminum powder can be easily formed on the substrate film by a coating process and does not depend on the gaseous phase process such as a vapor deposition, and therefore it is not expensive to produce the thermal transfer sheet of the present invention.

DETAILED DESCRIPTION OF THE PREFERRED EMBODIMENT

Figure 1:
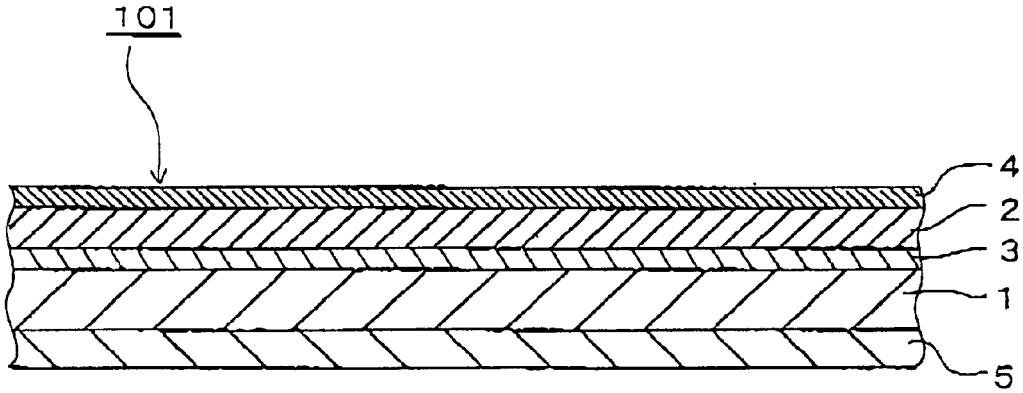
FIG. 1 is a schematically sectional view showing an example of a thermal transfer sheet according to the present invention.

Next, an embodiment according to the present invention will be explained. The fundamental form of a thermal transfer sheet according to the present invention is a structure in which at least a metallic layer 2 is disposed on one surface of a substrate film 1 as shown in FIG. 1. The thermal transfer sheet of the present invention may be provided with the other layers as required, and the optional layer include a peelable layer 3 disposed between the substrate film 1 and the metallic layer 2, an adhesive layer as an outermost layer 4 disposed on the metallic layer 2, and a heat resistant layer 5 disposed on the other surface of the substrate film 1.

Each layer constituting the thermal transfer sheet of the present invention will be hereinafter explained in detail.

(Substrate Film)

As the substrate used for the thermal transfer sheet of the present invention, not only the same substrate as those used for the conventional thermal transfer sheet may be used as it is but also other substrates may be used and there is no particular limitation to the type of substrate. Specific examples preferably used as the substrate include films of plastics such as a polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber and ionomer; papers such as condenser paper and paraffin paper; and nonwoven fabric. Composite substrate films obtainable by laminating these film materials may also be used. A particularly preferable substrate is a polyethylene terephthalate film. The thickness of the substrate is preferably, for example, about 2 to 25 $\mu$m though it may be changed corresponding to the type of material to obtain proper strength and heat conductivity.

(Metallic Layer)

The metallic layer disposed on the substrate contains at least leaf-shaped aluminum powder (Leafing type aluminum powder), and it may further contain a binder or another additive such as coloring agent, dispersing agent and anti-static agent as required.

The leaf-shaped aluminum powder can be produced by the following process:

Step 1: A carrier sheet having a peelability facilitating surface and wound in a roll form is taken or provided for the process. The peelability facilitating surface is formed in order to facilitate an aluminum coating film to be peeled or released from the surface of the carrier sheet. The peelability facilitating surface may be formed of a coating layer of plastic dissolvable by a remover solvent.

As a carrier sheet, one provided with a peelability facilitating surface having an embossed pattern is preferably used. In this case, the peelability facilitating surface with the embossed pattern may be formed on a carrier sheet by providing a carrier sheet having a surface provided with an embossed pattern in advance, applying a coating solution containing the plastic dissolvable by a remover solvent on such an embossed surface of the carrier sheet, and then drying same.

Step 2: The aluminum is subjected to a vapor deposition to form an aluminum coating film on the peelability facilitating surface of the carrier sheet.

When using a carrier sheet provided with the peelability facilitating surface with the embossed pattern, the aluminum vapor deposition is carried out on the peelability facilitating surface to form an aluminum coating film in a form adhering in accordance with the embossed pattern of that surface.

Step 3: The peelability facilitating surface is dissolved by a proper solvent to separate the aluminum coating film from the carrier sheet.

Step 4: The aluminum coating film thus separated is finely divided or pulverized into a size suitable for using in a coating ink.

The leaf-shaped aluminum powder obtainable through such process as described above is thin and flat minute pieces, and typical one has a leaf-shape or a scale shape, and has a thickness in a range of about 0.01–0.05 $\mu$m, an average diameter in a range of about 10–50 $\mu$m.

A binder is used in order to hold the leaf-shaped aluminum powder in a form of the metallic layer. The binder to be used for the metallic layer preferably constituted primarily of a resin. Specific examples of the resin include cellulose type resins, melamine type resins, polyester type resins, polyamide type resins, polyolefin type resins, acrylic resins, styrene type resins, ethylene-vinyl acetate copolymers, vinyl chloride/vinyl acetate copolymers and thermoplastic elastomers such as styrene-butadiene rubber.

In particular, the resin conventionally used as a thermosensitive adhesive having a relatively low softening point, for example, in a range of 50–150° C. is preferably used. Among these resins used for the binder, cellulose type resins, melamine type resins and acrylic resins are preferably used in view of, particularly, transferability, abrasive resistance and heat resistance.

In addition, a wax component may be used by mixing it with the resin as far as the heat resistance and the like are not impaired.

Examples of the waxes include microcrystalline wax, carnauba wax and paraffin wax. Further, various waxes such as Fisher-Tropsch wax, various low molecular polyethylenes, haze wax, beeswax, spermaceti wax, insect wax, wool wax, shellac wax, candelilla wax, petrolatum, polyester wax, partially denatured wax, fatty acid ester and fatty acid amide are exemplified. Among these waxes, particularly those having a melting point of 50 to 85° C. are preferable. When the melting point is less than 50° C., a storage problem arises whereas when the melting point exceeds 85° C., inferior printing sensitivity is obtained.

The aforementioned metallic layer is preferably formed using an ink composition comprising a mixture which contains the leaf-shaped aluminum powder and further contains a coloring agent such as various dyes and pigments as required in a range of 90 to 20% by weight and the binder in a range of 80 to 10% by weight based on a total amount of solid components in the metallic layer. When the proportion of mixture containing the leaf-shaped aluminum powder and the coloring agent is smaller than the above range, the coating amount of the mixture must be increased to obtain a sufficient color density, bringing about insufficient printing sensitivity. On the other hand, when the proportion of the mixture is greater than the above range, no film formability is obtained, causing reduced abrasive resistance after printing is finished.

Formation of the metallic layer can be carried out in the following manner. That is, a coating solution prepared by dissolving or dispersing at least a leaf-shaped aluminum powder and a binder in a solvent and by further adding the coloring agent or additives as required is applied to the substrate film in an amount of about 0.1 to 5 g/m$^2$ and preferably about 0.3 to 1.5 g/m$^2$ in a dry state by a conventionally known method such as gravure direct coating, gravure reverse coating, knife coating, air coating or roll coating.

When the amount of a dry coating film is less than 0.1 g/m$^2$, a uniform coating layer cannot be obtained on account of a problem concerning film forming property. Also, when the coating amount exceeds 5 g/m$^2$, high energy is required when printing and transfer operations are carried out, giving rise to the problem that printing can be made only by means of a special thermal transfer printer.

(Peelable Layer)

The peelable layer to be formed on one surface of the above substrate film melts during thermal transfer and improves the peelability of the metallic layer from the substrate film and at the same time, at least a part thereof is transferred together with the metallic layer to cover the transferred metallic layer and function as a protect layer, thereby particularly imparting good lubricity to the transferred image and improving the abrasive resistance of the transferred image. Since the peelable layer is positioned at an upper side of the metallic layer after being made into a transferred image, it is required to have transparency to the extent that the metallic luster of the metallic layer can be seen through and the metallic luster is not deteriorated.

As a material forming the peelable layer, various resin and waxes having highly peelable ability may be used, and the materials include acrylic resins, olefin resins, silicone resins, fluororesins or various resins modified by silicone or fluorine. It is preferable to use wax as a major component of the peelable layer.

As this wax, various waxes which melt during printing to exhibit high peelability are preferable, Examples of the wax which is preferably used include various waxes such as microcrystalline wax, carnauba wax, paraffin wax, Fisher-Tropsch wax, various low molecular polyethylenes, haze wax, beeswax, spermaceti wax, insect wax, wool wax, shellac wax, candelilla wax, petrolatum, partially denatured wax, fatty acid ester and fatty acid amide. Among these waxes, particularly preferable wax is microcrystalline wax or carnauba wax which has a relatively high melting point and is hardly soluble in a solvent.

When the peelable layer contains the coloring agent such as dye and pigment and the metallic layer is seen through the colored peelable layer after being made into the transferred image, an original hue of the metallic layer is changed to the other hue to further improve the design or appearance of the transferred image. For example, when a peelable layer having a transparent color such as yellow, red, green and blue is laminated on the metallic layer having a silver color inherent in the leaf-shaped aluminum powder, the design or appearance is improved and the transferred image can be easily imparted with different metallic hue or luster such as golden, copper and bronze colors.

In a case where the coloring agent is incorporated into the peelable layer, the peelable layer may be formed into a two-or multi-layered structure comprising a peelable layer primarily formed of a wax and a colored layer primarily formed of a coloring agent and a binder resin.

The aforementioned peelable layer is preferably made into a thin layer with, for example, a thickness of about 0.1 to 2 $g/m^2$ in a dry state so as to prevent the sensitivity of the thermal transfer sheet from decreasing.

(Adhesive Layer)

The thermal transfer sheet of the present invention may be provided with the adhesive layer, which is disposed on the metallic layer and formed as an outermost layer capable of improving an adhesiveness of the transferred metallic layer to a printed surface of the transfer receiving material The adhesive layer is primarily formed of a thermoplastic resin capable of softening and exhibiting adhesiveness when heating by means of a thermal head, a laser or the like, and for the purpose of preventing the thermal transfer sheet in a roll form from causing blocking, the adhesive layer may contain an antiblocking agent such as waxes, amides of, esters of or salt of a higher fatty acid, fluororesins and powder of inorganic substances.

In a case where a transparent plastic film or another transparent material is used as the transfer receiving material and the transferred image is observed from a back side of the transfer receiving material, namely a surface opposite to the printed surface, the transferred image is formed as a reflected image relative to the image to be observed. In this case, the coloring agent such as dye and pigment may be contained in the adhesive layer to form a transparent and colored adhesive layer, and thus the transferred image to be observed from the back side is further improved in design, appearance or decoration, and original hue or luster of the metallic layer to be observed from the back side can be easily changed to different one such as golden, copper and bronze colors.

Examples of the thermoplastic resin to be used for the adhesive layer include ethylene/vinyl acetate copolymer (EVA), ethylene/acrylic acid ester copolymer (EEA), polyester resin, polyethylene, polystyrene, polypropylene, polybutene, petroleum resin, vinyl chloride resin, vinyl chloride-vinyl acetate copolymer, polyvinyl alcohol, vinylidene chloride resin, metacrylic resin, polyamide, polycarbonate, polyvinyl formal, polyvinyl butyral, acetyl cellulose, nitro cellulose, polyvinyl acetate, polyisobutylene, ethyl cellulose and polyacetal. Among these thermoplastic resins, those conventionally used as a thermo-sensitive adhesive having a relatively low softening point, for example, in a range of 50–150° C. are particularly preferable.

The adhesive layer may be primarily formed of wax substance described above in order to increase a transfer sensitivity or improve a transferability to a rough paper having a poor surface smoothness.

Formation of the adhesive layer can be carried out in the following manner. That is, a mixture of the thermoplastic resin and the additives is applied on the metallic layer by hot melt coating, and then cooling and solidifying same. Alternatively, a coating solution for the adhesive layer is prepared by dissolving or dispersing the thermoplastic resin and the additives in a proper organic solvent or water, and the thus prepared coating solution is applied to the metallic layer by a conventionally known method such as hot melt coating, hot lacquer coating, gravure direct coating, gravure reverse coating, knife coating, air coating or roll coating.

The adhesive layer is formed at an amount of about 0.05 to 5 $g/m^2$ in a dry state in general. When the amount of the adhesive layer is less than 0.05 $g/m^2$ , adhesion between the transfer receiving material and the metallic layer is inferior, causing transfer inferior during printing. On the other hand, when the coating amount exceeds 5 $g/m^2$, transfer sensitivity during printing is reduced and therefore no satisfying quality of printing can be obtained.

(Heat Resistant Layer)

In the present invention, a heat resistant layer which improves the lubricity of a thermal head and prevents sticking is preferably disposed on the surface which is in contact with a thermal head of the substrate film. The heat resistant layer is fundamentally composed of a heat resistant resin and a material functioning as a thermal releasing agent or a lubricant.

The provision of such a heat resistant layer ensures that thermal transfer printing can be carried out without sticking even when a thermal transfer sheet uses a plastic film having a low degree of heat tolerance as the substrate, whereby exhibiting the merits of the plastic film such as resistance to cutting and high processability.

This heat resistant layer is formed by appropriately using a composition obtained by adding a lubricant, surfactant, inorganic particle, organic particle, pigment and the like to a binder resin. Examples of the binder resin to be used for the heat resistant layer include cellulose type resins such as ethyl cellulose, hydroxyethyl cellulose, hydroxypropyl cellulose, methyl cellulose, cellulose acetate, cellulose acetate butyrate and cellulose nitrate; vinyl type resins such as polyvinyl alcohol, polyvinyl acetate, polyvinylbutyral, polyvinylacetal, polyvinylpyrrolidone, acrylic resins, polyacrylamide, and acrylonitrile/styrene copolymers; polyester resins; polyurethane resins; and silicone-modified or fluorine-modified urethane resins.

Among these resins, it is preferable to use a crosslinkable resin comprising a compound having several reactive groups, for example, hydroxyl groups in combination with a crosslinking agent such as polyisocyanate.

As to a method forming the heat resistant layer, a material prepared by adding a lubricant, surfactant, inorganic particle, organic particle, pigment and the like to the binder resin as aforementioned is dissolved or dispersed in a proper solvent to prepare a coating solution, which is then applied to the back side of the substrate film by a common coating means such as a gravure coater, roll coater or wire bar, followed by drying. Preferable thickness of the heat resistant layer is in a range of about 0.01–3 g/m$^2$ in the dried state.

The thermal transfer sheet of the present invention can be used in combination with various transfer receiving materials. Examples of transfer receiving materials include rough paper such as Kent paper, middle quality paper, high quality paper (woodfree paper), art paper, light coat paper, slight coat paper, coat paper, cast coat paper, synthetic resin or emulsion impregnated paper, synthetic rubber-latex impregnated paper, synthetic resin lined paper, synthetic paper, plastic sheet and laminated product composed of these materials. The examples of the transfer receiving sheet to be adaptable further include a label produced by subjecting a back face of the substrate of the transfer receiving material to a work imparting adhesiveness, and covering the adhesive back face thereof with a releasing sheet.

As stated above, the thermal transfer sheet according to the present invention has a structure in which the metallic layer containing at least leaf-shaped aluminum powder is disposed on one side of the substrate film. When the thermal transfer sheet of such a structure is used to form an aluminum coating film on a printed surface, the aluminum coating film thus formed has a scaly configuration of aluminum fine peaces, in which many peaces of the leaf-shaped aluminum powder come to the surface of the aluminum coating film and almost closely arranged along a lateral direction with edges of the respective peaces of the leaf-shaped aluminum powder being in contact or overlapped with each other, thus producing a highly smooth coating of aluminum and obtaining a printed product which has a high hiding property and metallic luster and is excellent in qualities including design, appearance or decoration.

Furthermore, the metallic layer can be easily formed on the substrate film by a coating process and does not depend on the gaseous phase process such as a vapor deposition, and therefore it is not expensive to produce the thermal transfer sheet of the present invention.

In general, a thermal transfer sheet provided with a transferable layer containing aluminum powder can provide a printed product having metallic luster, but the obtained metallic luster is inferior than that obtainable from transferring of the metallic vapor film. To the contrary, the thermal transfer sheet of the present invention is provided with the metallic layer containing the leaf-shaped aluminum powder, and transferring of the metallic layer can impart an excellent metallic luster comparable to that obtainable from transferring of the metallic vapor film to a printed product.

EXAMPLES

Next, the present invention will be explained in more detail by way of examples, in which all designations of parts and % are expressed on weight basis, unless otherwise noted.

Example 1

As the substrate, a polyethylene terephthalate film with a thickness of 4.5 $\mu$m was used.

A coating solution having the following composition for a heat resistant layer was applied to one surface of the above substrate in advance by gravure coating in a dry coating amount of 0.3 g/m$^2$ and dried to form a heat resistant layer.

Next, a coating solution having the following composition for a peelable layer was applied to the other surface of the above substrate by gravure coating in a dry coating amount of 0.7 g/m$^2$ and dried to form a peelable layer.

Next, a coating solution having the following composition for a metallic layer was applied to the peelable layer by gravure coating in a dry coating amount of 1.5 g/m$^2$ and dried to form a metallic layer, there by producing a thermal transfer sheet of Example 1.

| | |
|---|---|
| <Coating solution for a peelable layer> | |
| Carnauba wax emulsion (solid content: 40%): | 5 parts |
| Ethyl alcohol/Water (2/1 in weight ratio): | 10 parts |
| <Coating solution for a metallic layer> | |
| Leaf-shaped aluminum powder (Metalure, available from Avery Dennison): | 4 parts |
| Acrylic resin (BR75, available from Mitsubishi Rayon Co., Ltd): | 6 parts |
| Toluene: | 40 parts |
| Methyl ethyl ketone: | 40 parts |
| Propyleneglycolmonomethylether: | 10 parts |
| <Coating solution for a heat resistant layer> | |
| Styrene/acrylonitrile copolymer resin; | 11 parts |
| Linear saturated polyester resin: | 0.3 parts |
| Zinc stearyl phosphate: | 6 parts |
| Melamine resin powder: | 3 parts |
| Methyl ethyl ketone: | 80 parts |

Example 2

A thermal transfer sheet of Example 2 was produced in the same manner as in Example 1 except that the composition of the coating solution for a metallic layer of the Example 1 was altered to the following composition and dry coating amount thereof was changed to 1.0 g/m$^2$.

| <Coating solution for a metallic layer> | |
|---|---|
| Leaf-shaped aluminum powder (Metalure, available from Avery Dennison): | 3 parts |
| Polyester resin (VYLON 200, available from Toyo boseki Co., Ltd.): | 3 parts |
| Toluene: | 40 parts |
| Methyl ethyl ketone: | 40 parts |
| Propyleneglycolmonomethylether: | 14 parts |

Example 3

A thermal transfer sheet of Example 3 was produced in the same manner as in Example 1 except that the composition of the coating solution for a peelable layer was altered to the following composition and dry coating amount thereof was changed to 0.8 g/m$^2$, and a coating solution having the following composition for an adhesive layer was applied to the metallic layer by gravure coating in a dry coating amount of 0.8 g/m$^2$ and dried to form an adhesive layer.

| | |
|---|---|
| <Coating solution for a peelable layer> | |
| Blue pigment (Pigment blue 15:3): | 14 part |
| Acrylic resin (BR85, available from Mitsubishi | 10 parts |

-continued

| | |
|---|---|
| Rayon Co., Ltd.): | |
| Toluene: | 38 parts |
| Methyl ethyl ketone: | 38 parts |
| <Coating solution for an adhesive layer> | |
| Polyester resin (MD-1200, available from Toyo boseki Co., Ltd): | 10 parts |
| Carnauba wax: | 10 parts |
| Water: | 40 parts |
| Isopropyl alcohol: | 40 parts |

Example 4

As the substrate, a polyethylene terephthalate film with a thickness of 6.0 $\mu$m was used.

A coating solution for a heat resistant layer having the same composition as used in the Example 1 was applied to one surface of the above substrate in advance by gravure coating in a dry coating amount of 0.1 g/m$^2$ and dried to form a heat resistant layer.

Next, a coating solution for a peelable layer having the same composition as used in the Example 1 was applied to the other surface of the above substrate by gravure coating in a dry coating amount of 0.5 g/m$^2$ and dried to form a peelable layer.

Next, a coating solution having the following composition for a coloring layer was applied to the peelable layer by gravure coating in a dry coating amount of 1.0 g/m$^2$ and dried to form a coloring layer.

Next, a coating solution for a metallic layer having the same composition as used in the Example 1 was applied to the coloring layer by gravure coating in a dry coating amount of 0.5 g/m$^2$ and dried to form a metallic layer.

Next, a coating solution for an adhesive layer having the same composition as used in the Example 3 was applied to the metallic layer by gravure coating in a dry coating amount of 0.5 g/m$^2$ and dried to form an adhesive layer, thereby producing a thermal transfer sheet of Example 4.

| <Coating solution for a coloring layer> | |
|---|---|
| Blue pigment (Pigment blue 15:4): | 10 parts |
| Vinyl chloride-vinyl acetate copolymer resin (DENKALAC, available from Denkikagaku Kogyo Co., Ltd.): | 10 parts |
| Toluene: | 40 parts |
| Methyl ethyl ketone: | 40 parts |

Comparative Example 1

As the substrate, the same polyethylene terephthalate film provided with the heat resistant layer as used in the Example 1 was used.

A coating solution having the following composition for a metallic layer was applied to the other surface of the above substrate by gravure coating in a dry coating amount of 3.0 g/m$^2$ and dried to form a metallic layer, thereby producing a thermal transfer sheet of comparative Example 1.

| <Coating solution for a metallic layer> | |
|---|---|
| Rice wax (CP-200, available from Noda wax Co., Ltd.): | 16 parts |
| Paraffin wax (150F Paraffin available from Nihon seiro Co., Ltd.) | 16 parts |
| Ethylene-Vinyl acetate copolymer (EVAFLEX 310, available from Mitsui Polychemical Corporation) | 4 parts |
| Aluminum powder (available from Toyo aluminum Corporation) | 3 parts |
| Toluene: | 40 parts |
| Methyl ethyl ketone: | 20 parts |

Comparative Example 2

A thermal transfer sheet of Comparative Example 2 was produced in the same manner as in Example 3 except that the vapor deposition process was carried out on the peelable layer to form an aluminum vapor deposition layer with a thickness of 350 Å as the metallic layer.

(Test)

Using the thermal transfer sheets of the above Examples and Comparative Examples, printing was carried out in the following printing condition and the print products were evaluated for the metallic luster and the hiding property.

<Printing Condition>

A label printer available from the market (resolution: 300 dpi, printing speed: 100 mm/sec) was used. A transfer receiving material was a coat paper whose surface was wholly colored with yellow.

A test pattern was printed on the transfer receiving material with the use of the thermal transfer sheet by means of the label printer, and then a sample of printed product for evaluation was produced.

<Evaluation of Metallic Luster>

The print product obtained in the above printing condition was visually observed to evaluate the metallic luster according to the following decision criteria.

Criteria:

○: The metallic luster is high, and the appearance is good.

Δ: The metallic luster is not so high, and the appearance is not so good.

X: The metallic luster is low, and the appearance is bad.

<Evaluation of Hiding Property>

The print product obtained in the above printing condition was visually observed to inspect the degree of effect of the colored coat paper positioned beneath the metallic layer on the hue and luster of the metallic layer in the printed portion, and thus the hiding property was evaluated according to the following decision criteria.

Criteria:

○: The colored coat paper has no effect on the appearance of the printed portion, and the printed image is excellent in the hiding property.

Δ: The hue or luster of the printed image appears to be different from those inherent in the metallic layer by the effect of the colored coat paper, and the printed image is insufficient in the hiding property.

X: The hue or luster of the printed image appears to be considerably different from those inherent in the metallic layer by the effect of the colored coat paper, and the printed image is much insufficient in the hiding property.

(Result of Evaluation)

The results of the evaluation of the above Examples and Comparative Examples are shown in Table 1.

TABLE 1

| | Luster | Hiding property |
|---|---|---|
| Example 1 | ○ | ○ |
| Example 2 | ○ | ○ |
| Example 3 | ○ | ○ |
| Example 4 | ○ | ○ |
| Comparative example 1 | X | ○ |
| Comparative example 2 | Δ | Δ |

What is claimed is:

1. A thermal transfer sheet comprising a substrate film and a metallic layer disposed on one side of the substrate film, the metallic layer being comprising leaf-shaped aluminum powder.

2. A thermal transfer sheet according to claim 1, wherein the leaf-shaped aluminum powder is obtainable via a process in which an aluminum film is formed by a vapor deposition on a peelability facilitating surface of a carrier sheet, and the aluminum film is peeled off the carrier sheet and finely divided.

3. A thermal transfer sheet according to claim 1, wherein the thermal transfer sheet further comprises a peelable layer disposed between the substrate film and the metallic layer.

4. A thermal transfer sheet according to claim 3, wherein the peelable layer contains a coloring agent.

5. A thermal transfer sheet according to claim 1, wherein the thermal transfer sheet further comprises an adhesive layer as an outermost layer disposed on the metallic layer.

* * * * *